Fig. 1
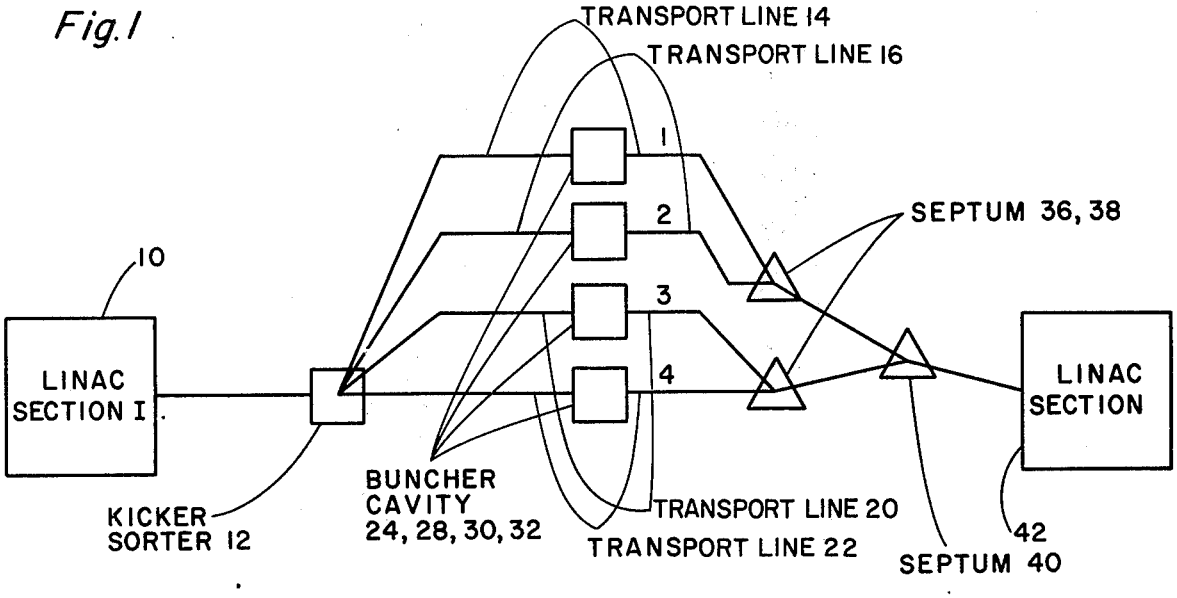
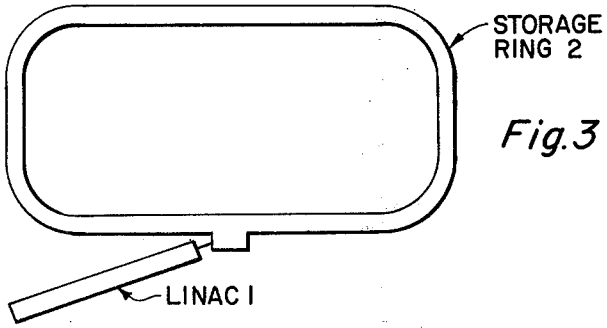
Fig. 3
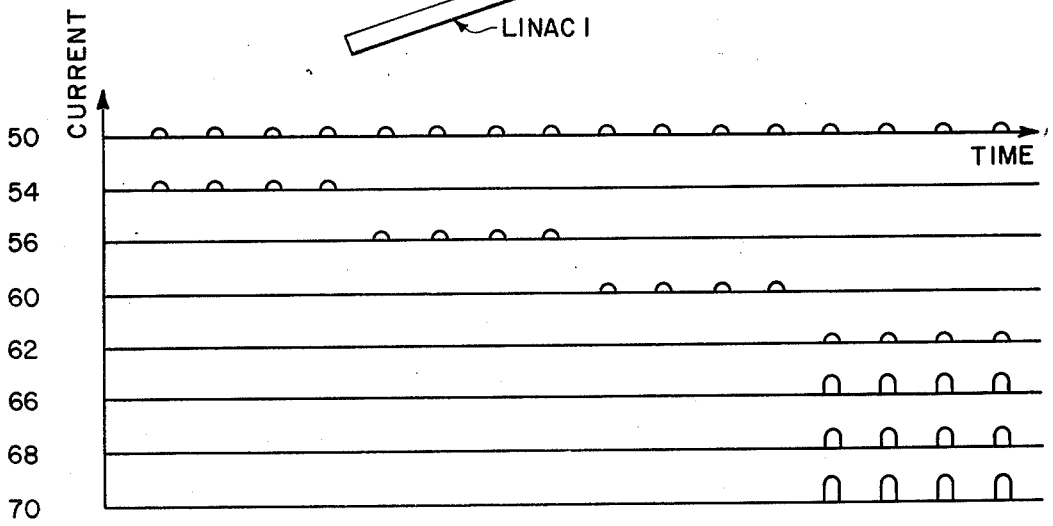
Fig. 2

United States Patent [19]

Maschke

[11] 4,172,236

[45] Oct. 23, 1979

[54] LOSS-FREE METHOD OF CHARGING ACCUMULATOR RINGS

[75] Inventor: Alfred W. Maschke, East Moriches, N.Y.

[73] Assignee: The United States as represented by the United States Department of Energy, Washington, D.C.

[21] Appl. No.: 916,182

[22] Filed: Jun. 16, 1978

[51] Int. Cl.[2] ..... H05H 9/00; H05H 13/04

[52] U.S. Cl. ..... 328/233; 328/235

[58] Field of Search ..... 328/233, 235

[56] References Cited

U.S. PATENT DOCUMENTS

| | | | |
|---|---|---|---|
| 3,303,426 | 2/1967 | Beth | 328/235 |
| 3,328,708 | 6/1967 | Smith et al. | 328/235 |
| 3,344,357 | 9/1967 | Blewett | 328/233 |
| 3,375,452 | 3/1968 | Forsyth | 328/233 X |
| 3,386,040 | 5/1968 | Maschke | 328/235 |
| 3,571,642 | 3/1971 | Westcott | 328/233 |
| 4,069,457 | 1/1978 | Martin et al. | 328/235 |

OTHER PUBLICATIONS

"Sor-Ring: An Electron Storage Ring Dedicated to Spectroscopy", Miyahara, et al., *Particle Accelerators*, vol. 7, No. 3, pp. 163-175, 1976.

*Primary Examiner*—Palmer C. Demeo

*Attorney, Agent, or Firm*—Dean E. Carlson; C. Daniel Cornish

[57] ABSTRACT

A method for the production of high current pulses of heavy ions having an atomic weight greater than 100. Also a linear accelerator based apparatus for carrying out said method. Pulses formed by the method of the subject invention are suitable for storage in a storage ring. The accumulated pulses may be used in inertial fusion apparatus.

6 Claims, 2 Drawing Figures

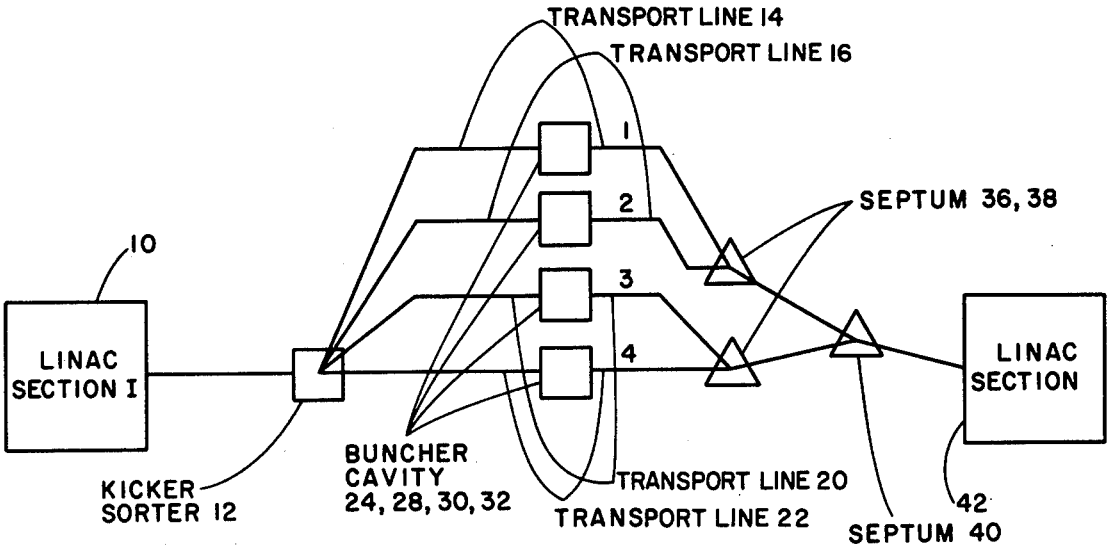

LOSS-FREE METHOD OF CHARGING ACCUMULATOR RINGS

BACKGROUND AND BRIEF SUMMARY OF THE INVENTION

This invention was made under, or during the course of a contract with the United States Department of Energy.

This invention relates to a method and apparatus for storing high current beams of charged particles in an accumulator ring.

One method for the possible production of controlled thermonuclear reaction is the use of energetic beams, such as beams of electromagnetic radiation, electrons, or more particularly beams of heavy ions. By heavy ions herein is meant ions of atomic species having atomic weight greater than approximately 100. It is contemplated that such beams of heavy ions would be focussed on small targets of isotopic hydrogen whereby a thermonuclear reaction would be caused in the target. Such a scheme would require brief, dense (i.e. high current pulses) of accelerated heavy ions. One method for producing such pulses would be to accelerate suitable heavy ions and store them as a high current recirculating beam in an accumulator, or storage ring. By accumulator, or storage ring herein is meant an apparatus for confining energetic charged particles magnetically in an approximately circular orbit. Design and construction of a suitable accumulator ring would be obvious to a person skilled in the art of particle accelerator design. Further details of such design are not relevant to the description of the subject invention.

A key problem for heavy ion fusion is the rapid accumulation of megajoules of beam which will subsequently be bunched and directed to a target. The three possible methods of accumulating beam in the storage ring are "multiturn injection," "stacking in momentum space," and "box car stacking".

By "multiturn injection" herein is meant the method of accumulating charge in an accumulator ring, wherein an essentially continuous beam is accumulated for a period of time greatly exceeding the cycle time of the accumulator ring so that over a number of cycles a high current beam is accumulated. By "stacking in momentum space" herein is meant the method of accumulating a beam wherein segments of the accumulated beam are injected with slightly varying momentum, so various segments assume orbits with slightly varying radii within the accumulator ring.

A difficulty with multiturn injection is that in a typical application it is rather lossy. With care, and a beam of sufficiently low emmitance, one might hope to obtain approximately ninety percent injection efficiency, but even at these levels the large amount of beam power loss in the accumulator might have serious consequences for the machine operation. "Stacking in momentum space" is not applicable here because the subsequent bunching required increases the momentum spread by a large factor. These methods and the problems associated therewith are well understood by those skilled in the art of accelerator design, and a further description thereof is not relevant to the description of the subject invention. In "box car stacking" the particles to be accumulated are typically accelerated in a synchrotron-type accelerator. By synchrotron accelerator herein is meant an apparatus for accelerating charged particles wherein the particles are accelerated as they traverse in an approximately circular orbit. This is in contrast to a linear accelerator, or LINAC, wherein the particles to be accelerated are accelerated in a linear path.

For high power fusion applications, a circular accelerator for heavy ions is not likely to be competitive with the linear accelerator. This is principally because one requires rather high average efficiencies and large average power. Efficiencies greater than approximately ten percent, and average powers of from thirty to fifty megawatts, are necessary for such high power fusion applications. While a linear accelerator can be built to satisfy these constraints, the output of a LINAC is an essentially continuous constant current beam suited for multiturn injection.

A problem with LINACS is that the current is limited by the effects of space charge at the injection, or low energy, end of the accelerator. By space charge effects herein is meant the mutually repulsive forces acting between the particles. Since a LINAC is a constant current device, this space charge effect limits the maximum instantaneous output current. However, as the particles are accelerated and moved through the LINAC, the effects of space charge are reduced with increasing energy.

The subject invention overcomes these problems by means of a modified linear accelerator suitable for use as an injector for a storage ring comprising: an ion source; a linear accelerating system for accelerating the ions produced by said source; means for sequentially diverting portions of the output of said accelerating system; a plurality of transport lines, each receiving one of said diverted portions; and wherein the ions receive no further acceleration, and having different transit times so chosen that each of said diverted portions reaches the output of said transport line substantially simultaneously, buncher cavities being located on at least one of said transport lines whereby the debunching of the associated diverted portion is connected and, means for recombining the outputs of said transport lines into a single beam. A linear accelerator comprising one or more of the above described sections would have an output of short, high current bursts at relatively long intervals. The interval between bursts is chosen to be slightly greater than the cycle time of the accumulator. These bursts may be injected into the accumulator so as to fill the accumulator with a high current beam, as will be more fully described hereinafter.

BRIEF DESCRIPTION OF THE DRAWINGS

FIG. 1 is a schematic representation of an embodiment of the subject invention.

FIG. 2 is a graphical representation of current versus time at various points in FIG. 1.

FIG. 3 is a schematic representation of an apparatus for storing high current beams of heavy ions.

DETAILED DESCRIPTION OF THE INVENTION

Referring now to FIGS. 1 and 2, an ion source (not shown) provides a source of charged particles at substantially the maximum current allowed by the space charge effect. Particles are accelerated by the first linac section 10 until they reach an energy where the space charge effects are reduced sufficiently that a current approximately four times as great is possible. The output of the first linac section 10 has approximately the appearance represented graphically by line 50 of FIG. 2. The beam then enters kicker sorter 12. Kicker sorter 12 is a fast rise time magnetic system which deflects portions of the beam into the transport lines—14, 16, 20, 22. Inputs to transport line 14, 16, 20, 22 are shown graphically by lines 54, 56, 60 and 62 of FIG. 2. Transit times of transport lines 14, 16, 20, 22 are so chosen that the portions of the beam in each line reach the outputs of their respective transit lines approximately simultaneously. Outputs of lines 14 and 16 are combined by septum magnet 36. Outputs of lines 20, 22 are combined by septum magnet 38. Outputs of magnets 36, 38 are represented graphically by lines 66, 68 of FIG. 2. Outputs of magnets 36, 38 are further combined by septum magnet 40. The output of magnet 40 is graphically depicted by line 70 of FIG. 2. The output of magnet 40 may then be further accelerated by second linac section 42. In practice, there is an effective reduction in peak current since each of the portions of the beam will be debunched (i.e. spread out) differently by kicker sorter 12. This is corrected by buncher cavities 24, 28, 30, 32 located at the midpoints between linac sections 10, 12 wherein an appropriate electromagnetic field is applied to the beam portions in each of the transport lines 14, 16, 20, 22 to correct for the debunching effect.

As may be seen by examination of FIG. 2, the output of linac section 10 has been converted into bursts or bunches of high current pulses. An injector for use in a heavy ion diffusion system would comprise a plurality of sections such as are hereinabove described so as to produce high current bursts of particles suitable for use in "box car stacking" as would be more fully described hereinafter.

The design, construction and operation of each of the components of the system hereinabove described, would be obvious to a person skilled in the art of particle accelerator design.

THEORETICAL EXAMPLE

Suppose, referring to FIGS. 1 and 3, we want to fill the storage ring 2 up to the 5 ampere level. If we have linac 1 capable of producing 40 mA of beam, we could fill the ring in 125 turns, via multi-turn injection. In order to fill ring 2 "box-car" fashion, we need high current "bursts" from linac 1. Suppose this to be a 10 ampere burst, lasting for 40 ns. Assuming that we have a single burst injection system with a rise time $\leqq 40$ ns, we can arrange to time our bursts so that they occur sequentially spaced around storage ring 2. For our example, if we keep to a 40 mA average current, with 10 amps in the burst, this means a 10 μsec interval between bursts. If the revolution period of ring 2 was 9.92 μsec, the next linac burst would arrive in the ring just 80 ns behind the initial burst, and so on until the ring was filled.

We suppose linac 1 starts out with a long pulse (for our example, the pulse length must be $\sim 125 \times 10$ μsec $= 1.25$ ms) with no structure other than the normal linac bunch structure. At the appropriate energy, we use very fast rise time kicker 12 to deflect the beam into 4 different transport channels 14, 16, 20, 22 at 40 ns intervals. The lengths of channels 14, 16, 20, 22 are arranged so that the beam can be brought back together at the same time. This is done with three lines with transit times of 40 ns, 80 ns, and 120 ns, say. Beams 1 and 2, and Beams 3 and 4 are combined, by septum magnets 36, 38 to produce two beams of larger horizontal emittance. This can be done with virtually no beam loss, and a phase space dilution factor of about 1.5. The two beams are then combined in identical fashion in the vertical plane by septum magnet 40.

The net result of this procedure is that we have taken an essentially "DC" beam of 40 mA, and produced a "chopped" beam, containing 40 ns bursts of 160 mA at 160 ns intervals. The price we have paid is that our transverse phase space is 3 times larger. However, the momentum spread, i.e., the longitudinal phase space, has not been diluted. This is basically a method of exchanging transverse phase space density to obtain higher longitudinal phase space density.

As a practical matter, there is an effective dilution of longitudinal phase space which would occur as a result of each beam debunching by a different amount. This can be corrected by putting a "buncher" cavity at the midpoint between the two linac sections. FIG. 1 shows a schematic of the process.

If the above process was repeated three more times, at appropriate energies, we would wind up with 10 ampere bursts, 40 ns long, at 10 μsec intervals. The thing which allows this system to work is the fact that the stored energy in each linac tank is much greater than the energy removed by the burst. Typical values for a 200 MHz Alvarez structure give about 4 Joules/MV, and our burst removes about 0.4 Joules. The energy spread between the first and last bunches of the 40 ns burst can be compensated for by the intermediate buncher cavities, or by the debuncher cavity at the end of the linac.

Now let us look at space charge considerations. The longitudinal space charge forces scale in such a way that we have:

$$\frac{i_{LSC} A f}{\bar{\epsilon} E} - \text{constant.}$$

where $\bar{\epsilon}$ is the average electric field, E the energy of the particle, A the atomic weight, f the linac frequencym and $i_{LSC}$, the longitudinal space charge limiting current. The constant can be determined empirically by examination of existing linacs operating near the space charge limit. The AGS linac, with 100 mA at 0.75 MeV, assures us of a longitudinal space charge limiting current in excess of 25 amperes at 200 MeV.

The transverse space charge limit goes up even more rapidly with energy, and so will not be of limiting concern.

To complete our example, let us consider a linac starting at 10 MeV and accelerating Uranium to 40 GeV. We perform our current bunching operation at 56 MeV, 316 MeV, 1.8 GeV, and 10 GeV. If our final emittance is about $\epsilon = 10^{-4}$ at 40 GeV, our intermediate emittances are:

| Energy | $\epsilon$ | I |
|---|---|---|
| 10 MeV | $0.8 \times 10^{-4}$ | 0.04 amps |
| 56 MeV | $1.0 \times 10^{-4}$ | 0.14 amps |
| 316 MeV | $1.2 \times 10^{-4}$ | 0.64 amps |
| 1.8 GeV | $1.6 \times 10^{-4}$ | 2.5 amps |
| 10 GeV | $2 \times 10^{-4}$ | 10.0 amps |
| 40 GeV | $1 \times 10^{-4}$ | 10.0 amps |

At 10 MeV, the transverse current limit is about 0.18 amperes for this value of emittance, and a charge 10 state. Therefore, we are well within the limit at the start, and things get better as we accelerate. The longitudinal space charge limit, using the FNAL linac is the benchmark, requires the frequency to be below 75 MHz. 25 MHz is a likely frequency choice for this early section, so that that should not present a problem.

What is claimed is:

1. A linear accelerator for use as an injector for a storage ring, comprising:
   a. a source of charged particles;
   b. a linear accelerating means for accelerating said particles;
   c. means for sequentially diverting portions of the output of said accelerating systems;
   d. a plurality of transport line means for each receiving one of said diverted portions and having different transit times so chosen that each of said diverted portions reaches the outputs of said transit line means substantially simultaneously;
   e. bunching cavity means located on one of said transport lines for correcting longitudinal dispersion of the associated diverted portion; and
   f. means connected to the outputs of said transport line means for recombining said diverted portions so as to increase the peak current of said particles.

2. A linear accelerating system as described in claim 1 wherein said charged particles consist essentially of uniformly charged ions of a chemical species having an atomic weight in excess of 100.

3. An apparatus for storing a high current beam of heavy ions comprising:
   a. a linear accelerator as described in claim 2;
   b. storage ring means for accumulating a beam of said heavy ions, said storage means having a cycle time sufficiently less than the repetition period of said pulses of said linear accelerator so that sequential output pulses of said linear accelerator may be injected into said storage ring means substantially adjacent to the preceding pulse approximately one cycle time after said preceding pulse is injected; and,
   c. means for injecting said output pulses into said storage ring means.

4. A method of producing pulses of charged particles, comprising:
   a. accelerating a beam of said charged particles in a linear accelerator;
   b. diverting sequential portions of said beam at the output of said accelerator;
   c. selectively delaying said diverted portions so that all of said diverted portions are simultaneous and
   d. recombining said diverted portions into a single pulse.

5. The method of claim 4 wherein said charged particles consist essentially of ions of a chemical species having an atomic weight in excess of 100.

6. A method for producing a high current beam of heavy ions comprising:
   a. producing pulses of said heavy ions by the method of claim 5; and
   b. accumulating said pulses in a storage ring means having a cycle time sufficiently less than the repetition period of said pulses so that said pulses may be injected into said storage ring means substantially adjacent to the preceding pulse approximately one cycle time after the preceding pulse is injected.

* * * * *